US005940909A

United States Patent [19]

Sapp

[11] Patent Number: 5,940,909

[45] Date of Patent: Aug. 24, 1999

[54] REVERSIBLE PILLOW CASE

[75] Inventor: William Sapp, Marietta, Ga.

[73] Assignee: Crown Crafts, Inc., Atlanta, Ga.

[21] Appl. No.: 09/119,634

[22] Filed: Jul. 21, 1998

[51] Int. Cl.[6] ..... A47H 9/00

[52] U.S. Cl. ..... 5/490; 5/482; 5/486; 5/502

[58] Field of Search ..... 5/490, 491, 492, 5/482–485, 486–496, 502

[56] References Cited

U.S. PATENT DOCUMENTS

| | | | |
|---|---|---|---|
| 2,008,285 | 7/1935 | Kraus | 5/490 |
| 3,109,474 | 11/1963 | Levi | 5/490 |
| 4,419,779 | 12/1983 | Janesh | 5/490 |
| 4,815,154 | 3/1989 | Grimes | 5/490 |

*Primary Examiner*—Michael F. Trettel
*Assistant Examiner*—Frederick Conley
*Attorney, Agent, or Firm*—Howrey & Simon; Michael J. Bell; Erik B. Milch

[57] ABSTRACT

A reversible pillowcase which is formed by folding a single piece of fabric into substantially three equal portions. The portions are attached together along two sides, thus forming first and second pockets with openings at opposite ends. Inverting the first pocket forms a pillowcase by exposing one decorative surface of the fabric and hiding the stitching used to attach the portions. Inverting the second pocket exposes a second decorative surface while also hiding the stitching. Thus a reversible pillowcase can be converted between two different decorative appearances while also hiding the unsightly stitching used in manufacturing the article.

7 Claims, 3 Drawing Sheets

REVERSIBLE PILLOW CASE

BACKGROUND OF THE INVENTION

1. Field of the Invention

The present invention relates generally to the art of decorating and more particularly to a reversible, decorative pillowcase.

2. Description of the Related Art

There have been prior patents associated with bedroom decorations and particularly with decorations associated with reversible covers for pillows or like furniture pads. For example, there are patents which disclose a reversible cover for pillows which comprises in essence a pair of flexible panels of cloth joined to each other along three sides by sewed seams. The drawback of this sort of invention is that the stitching used in manufacturing the article will be exposed on at least one side of the pillow cover. These patents fail to teach forming a dual pocket reversible pillow cover that hides unsightly stitching as in the present invention.

There are other patents which disclose reversible furniture covers wherein each delineated side comprises a pair of fabric panels disposed in juxtaposition relative to each other with each pair having, preferably, a different color. This sort of cover utilizes multiple fabric panels sewn together which can be reversibly manipulated to expose alternative decorative surfaces. These patents fail to teach or describe the use of a unitary construction fabric which is formed into dual pockets thereby creating a reversible pillow cover that hides unsightly stitching as in the present invention.

Other patents disclose invertible comforters to provide alternatives in bedroom decor. These comforters may be manually turned to expose its finished interior surfaces via an unstitched length along its bottom edge. As with other related inventions, when at least one of the two surfaces is facing outwardly, the seam holding the sheets of fabric together is exposed.

Other patents which are generally related disclose a convertible pillow/chair pad which They do not teach or describe the use of a unitary construction fabric which is formed into dual pockets thereby creating a reversible pillow cover that hides unsightly stitching as in the present invention.

In light of the foregoing, there is a need for a pillowcase that is easily reversible without exposure of unsightly seams, even with surfaces of different color or design.

SUMMARY OF THE INVENTION

Accordingly, the present invention is directed to a reversible pillowcase that substantially obviates one or more of the problems due to limitations and disadvantages of the related art.

The principal advantage of the present invention is an improved arrangement, which substantially obviates one or more of the limitations and disadvantages of the described prior arrangements.

Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention consists of a single piece of fabric folded into three substantially equal portions and attaching the portions together along their two sides. Thus, a pillowcase is formed which has a first and second pocket on opposite ends. The first pocket can be inverted to expose a first surface of the piece of fabric. In doing so, a third pocket is defined into which a pillow can be placed. Alternatively, the second pocket can be inverted to expose the second surface of the piece of fabric thereby defining a fourth pocket into which a pillow can be placed.

It is an object of the present invention to provide a pillowcase having two decorative surfaces which are reversibly exposed.

It is another object of the present invention to provide a reversible pillowcase which conceals any unsightly stitching regardless of which decorative surface is exposed.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
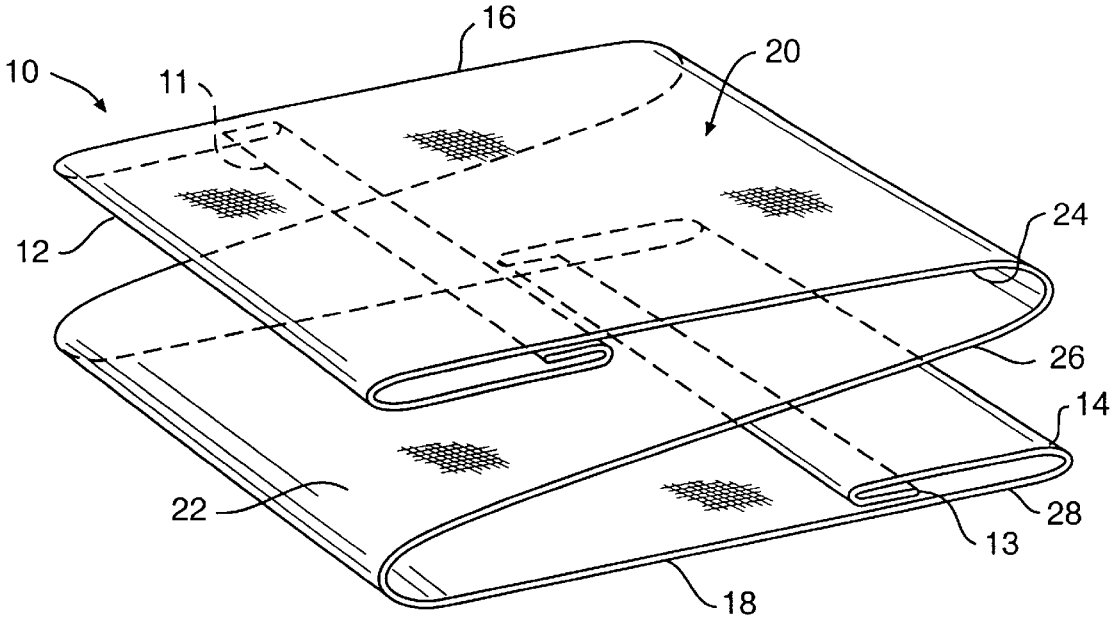
FIG. 1 is an exploded view of the reversible pillow case according to the present invention.

The exemplary embodiment of the reversible pillowcase is shown in FIG. 1 and is designated generally by reference numeral 10. As embodied herein and referring to FIG. 1, the reversible pillowcase 10 includes a single piece of fabric in the shape of a parallelogram. The parallelogram has a first side 11; a second side 13 opposite the first side 12; a third side 16; and a fourth side 18 opposite the third side 16. The piece of fabric further has a first surface 20 and a second surface 22 opposite the first surface 20; a first portion 24, a second portion 26; and a third portion 28. The first portion 24 is adjacent to the first side 12, the third portion 28 is adjacent to the second side 14, and the second portion 26 is positioned between the first portion 24 and the third portion 28.

A portion of the first portion 24 may be folded over to form a first border 38 on the second surface 22 along the first side 11 and to create a first edge 12. A portion of the third portion 28 may be also folded over to form a second border 40 on the first surface 20 along the second side 13 and to create a second edge 14. The reversible pillowcase 10 may, however, be formed with or without the first border 38 and the second border 40. If no borders 38, 40 are included, then first side 11 would be positioned at first edge 12 and second side 13 would be positioned at the second edge 14.

Figure 2:
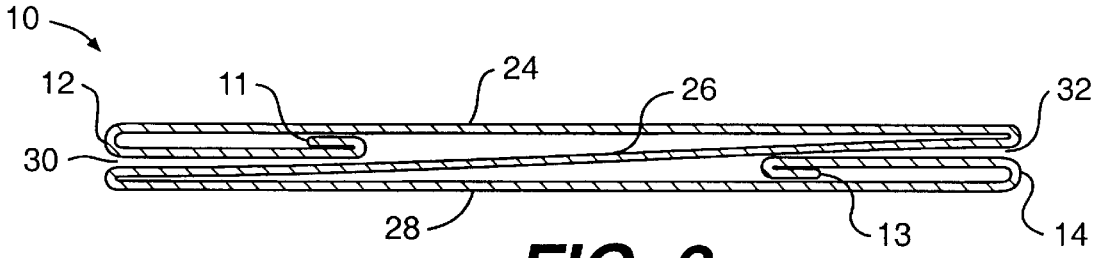
FIG. 2 is a cross sectional view of the reversible pillow case according to the present invention.
Figure 3:
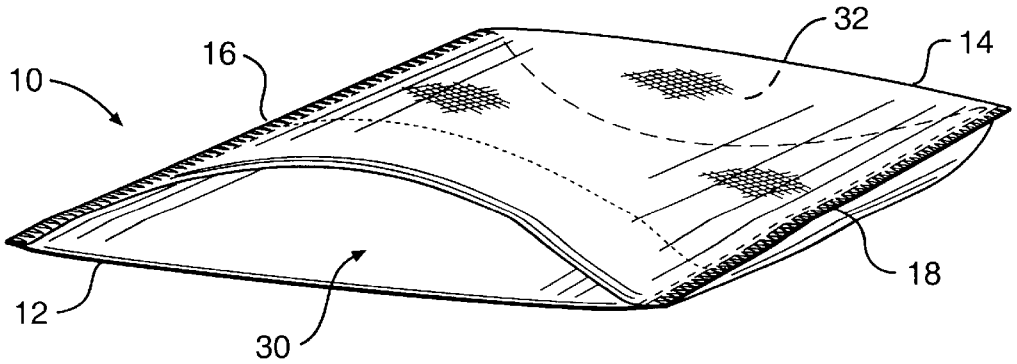
FIG. 3 is a perspective view of the reversible pillow case according to the present invention with the first and second pockets depicted in the open position prior to forming the third or fourth pocket.
Figure 4:
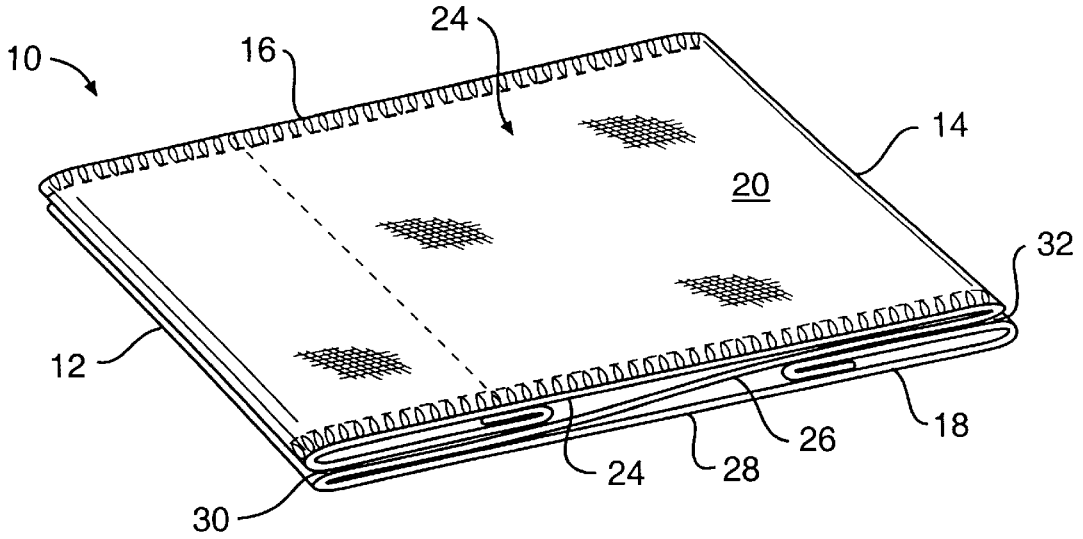
FIG. 4 is a perspective view of the reversible pillowcase according to the present invention prior to forming the third or fourth pocket.
Figure 5:
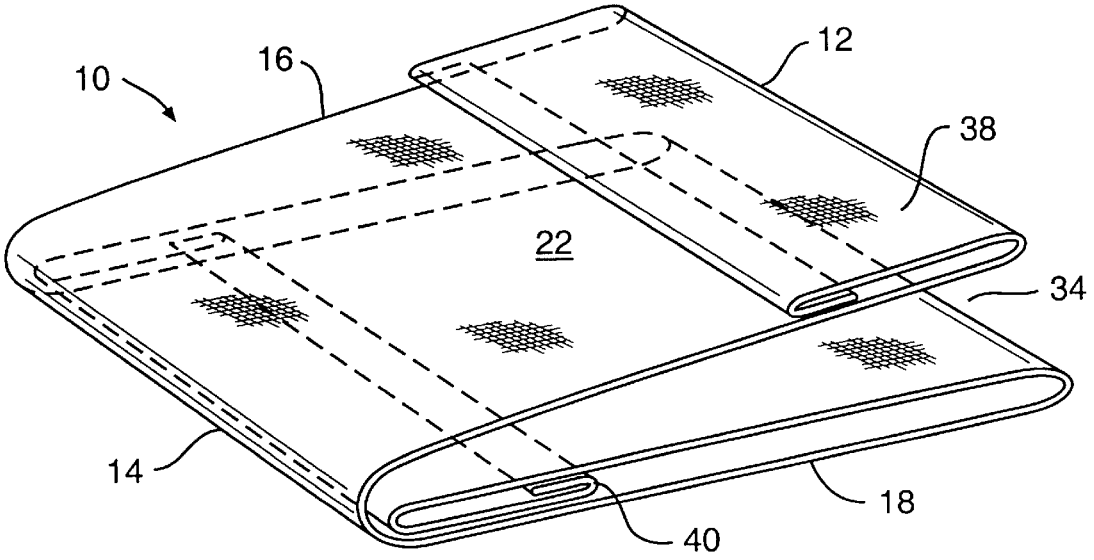
FIG. 5 is an exploded view of the reversible pillowcase according to the present invention after forming the third or fourth pocket for receiving a pillow.
Figure 6:
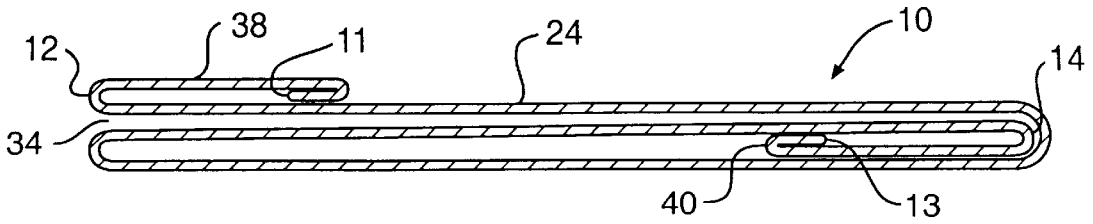
FIG. 6 is a cross-sectional view of the reversible pillow case according to the present invention after forming the third or fourth pocket.
Figure 7:
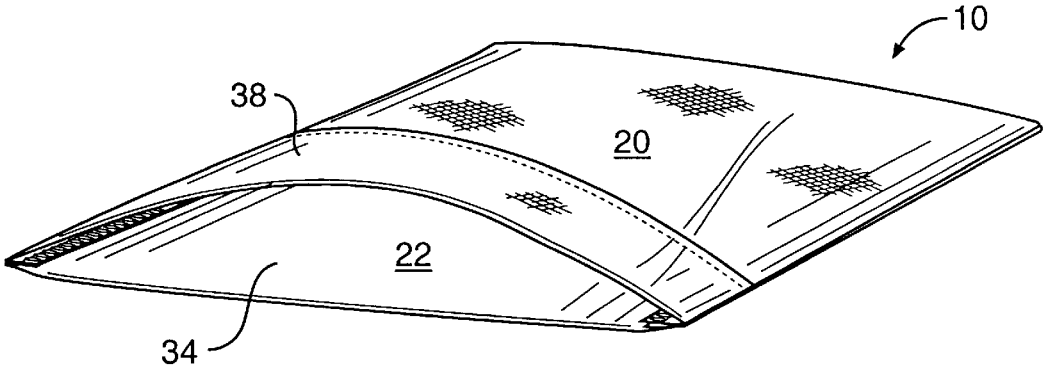
FIG. 7 is a perspective view of the reversible pillowcase according to the present invention after forming the third or fourth pocket for receiving a pillow.
Figure 8:
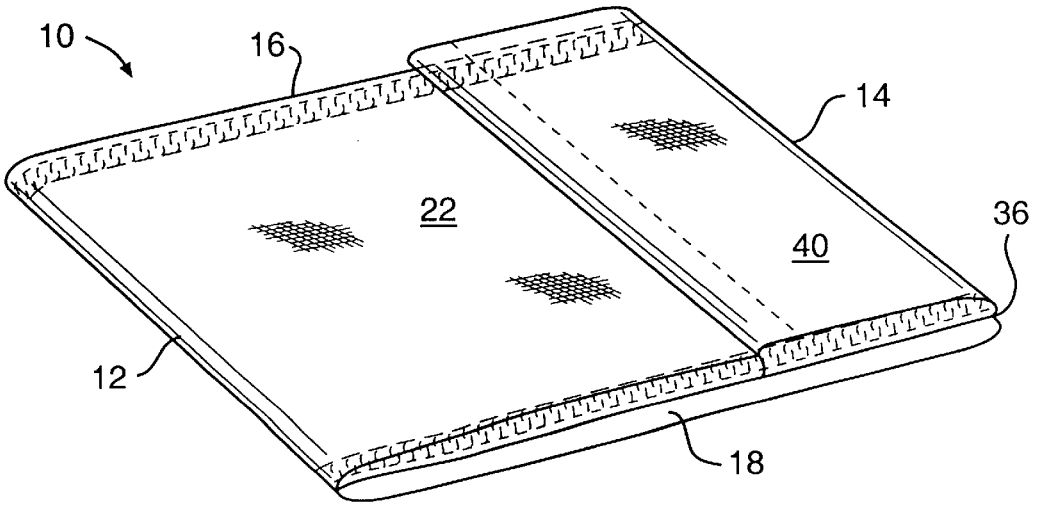
FIG. 8 is a perspective view of the reversible pillow case according to the present invention depicting the decorative border of the pillowcase after forming the third or fourth pocket for receiving a pillow.

In order to form the pillowcase 10, as shown in FIG. 1, the single piece of fabric is folded to position the first portion 24 above the second portion 26, and the second portion 26 above the third portion 28 such that the first edge 12 remains opposite the second edge 14. As shown in FIG. 2, the folded portions are attached together along the third side 16 and the fourth side 18 to form a first pocket 30 with an opening along the first edge 12 and a second pocket 32 along the second edge 14. FIG. 7 shows that the first pocket 30 may be turned inside-out or inverted to form a third pocket 34 with the first surface 20 of the piece of fabric exposed facing outwardly. The second pocket 32 may alternatively be turned inside-out or inverted forming a fourth pocket 36 with the second surface 22 of the piece of fabric exposed facing outwardly.

The fabric can be colored with a variety of color schemes. For example, the first surface 20 can be one color, while the second surface 22 is another color. Another possibility is that the color of the first surface 20 and the second surface 22 are substantially the same. Additionally, the first surface 20 and the second surface 22 can be provided with different or similar decorative designs thereon.

It will be apparent to those skilled in the art that various modifications and variations can be made in the reversible pillowcase of the present invention without departing from the spirit or scope of the invention. Thus, it is intended that the present invention cover the modifications and variations of this invention provided they come within the scope of the appended claims and their equivalents.

I claim:

1. A reversible pillow case comprising:

a folded piece of fabric in the shape of a parallelogram having a first side, a second side opposite said first side, a third side, a fourth side opposite said third side, said piece of fabric having:

a first surface, a second surface opposite said first surface; and a first portion, a second portion, and a third portion, said first portion being adjacent to said first side, said third portion being adjacent to said second side, said second portion being positioned between said first portion and said second portion;

wherein the piece of fabric is folded such that the first portion is positioned above the second portion, which is positioned above the third portion, and the first side remains opposite the second side;

wherein upon folding, said first, second, and third portions are coupled along said third side and said fourth side so as to define a first and a second pocket, said first and said second pocket being capable of being inverted and said first pocket having an opening along said first side, and said second pocket having an opening along said second side;

wherein when said first pocket is inverted, a third pocket having said first surface of said piece of fabric outwardly exposed is defined; and wherein when said second pocket is alternatively inverted, a fourth pocket having said second surface of said piece of fabric outwardly exposed is defined.

2. The reversible pillowcase according to claim 1, wherein said first surface of said piece of fabric has a first color and said second surface has a second color.

3. The reversible pillowcase according to claim 1, wherein said first surface of said piece of fabric is provided with a first design and said second surface is provided with a second design.

4. The reversible pillowcase of claim 1, wherein said first surface and said second surface have substantially the same color.

5. The reversible pillowcase of claim 1, wherein said first surface and said second surface of said piece of fabric are provided with substantially the same design.

6. The reversible pillowcase of claim 1, wherein a portion of said first portion is folded over near said first side forming a first border on said second surface along said first side.

7. The reversible pillowcase of claim 1, wherein a portion of said third portion is folded over near said second side forming a second border on said first surface along said second side.

* * * * *